US006431951B2

(12) United States Patent
Onose et al.

(10) Patent No.: US 6,431,951 B2
(45) Date of Patent: Aug. 13, 2002

(54) ONLINE ROLL GRINDING METHOD AND ONLINE ROLL GRINDING APPARATUS

(75) Inventors: Mitsuru Onose; Shigeru Mori, both of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1 day.

(21) Appl. No.: 09/768,455

(22) Filed: Jan. 25, 2001

(30) Foreign Application Priority Data

Jan. 25, 2000 (JP) ..... 2000-016145

(51) Int. Cl.[7] ..... B24B 5/04

(52) U.S. Cl. ..... 451/5; 451/49; 451/142; 451/258

(58) Field of Search ..... 451/49, 254, 258, 451/142, 146, 290, 348, 424, 461, 5, 11, 14

(56) References Cited

U.S. PATENT DOCUMENTS 5,562,525 A * 10/1996 Mori et al. ..... 451/5
5,618,224 A * 4/1997 Dumas ..... 451/142
5,738,570 A * 4/1998 Rosenthal et al. ..... 451/119
5,853,318 A * 12/1998 Thom et al. ..... 451/425
6,283,823 B1 * 9/2001 Mori et al. ..... 451/5

* cited by examiner

*Primary Examiner*—George Nguyen
(74) *Attorney, Agent, or Firm*—Crowell & Moring LLP

(57) ABSTRACT

Upper and lower working rolls 2*a*, 2*b* are ground while moving respective grindstone devices 3*a*, 3*b* in reverse directions, whereby the region of grinding for the upper working roll 2*a* and that for the lower working roll 2*b* are maintained in symmetry with respect to the center of rolls, one on the operating side and the other on the driving side. By this arrangement, it is possible to equalize the coefficients of friction on the operating side and the driving side, and to prevent meandering of the rolling stock 6 as well as drawing (squeezing) or bad product shape due to the meandering from occurring. The timings to start grinding by the grindstone devices 3*a*, 3*b* are set to be substantially the same, and the velocities of movement of the grindstone devices 3*a*, 3*b* in the axial direction of the working rolls are set to be equal, whereby the difference in frictional coefficient due to grinding in the longitudinal direction of the rolls can stably be kept small.

4 Claims, 9 Drawing Sheets

ONLINE ROLL GRINDING METHOD AND ONLINE ROLL GRINDING APPARATUS

BACKGROUND OF THE INVENTION

The present invention relates to an online roll grinding method and an online roll grinding apparatus for grinding the surfaces of working rolls during rolling operation of a rolling mill.

Generally, working rolls of a rolling mill during rolling of a plate are worn at only rolling portions thereof with the result of steps formed between the rolling portions and non-rolling portions of the working rolls, and, therefore, a rolling system has been adopted which is limited in that the rolling schedule must be from wider rolling stocks to narrower rolling stocks. Besides, the life of the working roll has been determined in consideration of the influences on product quality of formation of the steps and variations in roughness of the working roll surfaces due to rolling. Due to the life of the working rolls determined in this manner, the number of rolling stocks which can be rolled by use of the same working rolls has been restricted.

On this account, there has hitherto been proposed an online roll grinding apparatus such as described in Japanese Patent Publication No. 2708351. This apparatus eliminates the above-mentioned schedular limitation on the rolling system (from wider rolling stocks to narrower rolling stocks) to thereby achieve schedule-free rolling, and prevents the formation of working roll steps between rolling portions and non-rolling portions to thereby provide the working rolls with a uniform surface roughness, leading to a prolonged working roll life. Accordingly, the number of rolling stocks which can be rolled is increased, and the unit of working rolls is reduced. Thus, the apparatus is aimed at energy conservation, improved product quality and enhanced productivity.

According to the above-mentioned Japanese Patent Publication No. 2708351 "ROLLING MILL, ROLL GRINDING APPARATUS AND ROLLING METHOD", an online roll grinding apparatus comprises at least one grindstone device for each of upper and lower working rolls, and grinding is carried out while moving the grindstone device along the longitudinal direction of the working rolls over the entire length of the rolls. In the known example, there is no definition as to the moving direction during grinding of the grindstone devices disposed respectively for the upper and lower working rolls. Generally, for ease of control, during grinding the upper and lower grindstone devices are both moved along the longitudinal direction of the working rolls in the same direction, namely, either from a draft operating side (hereinafter referred to as "operating side") toward a rotationally driving side (hereinafter referred to as "driving side"), or from the driving side toward the operating side.

On the other hand, Japanese Patent Laid-open No. Hei 11-197721 discloses online roll grinding in which a grind grain with an angle of intersection relative to the circumferential direction of working rolls is provided for enhancing efficiency of grinding, wherein the directions of the grind grain pattern with the angle of intersection are determined to be symmetrical within the longitudinal direction of the working rolls, between the upper and lower working rolls, and between adjacent stands. By such grinding, frictional forces generated between the rolling stock and the working roll in the width direction are canceled, whereby meandering of the rolling stock is prevented.

In the online grinding apparatus disclosed in the above-mentioned Japanese Patent Publication No. 2708351, when the upper and lower grindstone devices for grinding the working rolls in the longitudinal direction are both moved in the same direction, namely, either from the driving side toward the operating side or from the operating side toward the driving side, there arises a difference of working roll surface roughness such that the ground portions of the working rolls have smaller surfce roughness and unground portions of the working rolls have larger surface roughness, along the longitudinal direction of each working roll and between the upper and lower working rolls upon grinding.

The difference in the surface roughness of the working rolls causes a variation in frictional coefficient in the longitudinal direction of the working rolls at the time of rolling. Because the number of the working rolls during grinding by the online roll grinding apparatus is two (upper one and lower one), the variation in the frictional coefficient is doubled. Due to the difference in the frictional coefficient generated in the width direction of the rolling stock and between the working roll surfaces upon rolling, the rolling stock meanders and there arises drawing (squeezing) or bad shape (end elongation, middle elongation) due to meandering. As a result, product quality is lowered, productivity is lowered, and the merit of the online roll grinding apparatus is reduced.

When rolling is carried out using working rolls which have preliminarily been ground before rolling according to the technique disclosed in the Japanese Patent Laid-open No. Hei 11-197721, frictional forces generated in the width direction of the rolling stock are canceled, and meandering of the rolling stock is prevented effectively. However, this known example also does not define the moving direction of the grindstone devices during grinding of the working rolls. It has been known that, when grinding is carried out by moving the upper and lower grindstone devices in the same direction during pass rolling by rotation of the working rolls, a difference in frictional force is generated in the width direction of the rolling stock, resulting in meandering of the rolling stock and attendant bad shape. Therefore, the technique of the known example permits grinding only during intervals of rolling, and is unsuitable for application to grinding during pass rolling.

SUMMARY OF THE INVENTION

Accordingly, it is an object of the invention to provide an online roll grinding method and an online roll grinding apparatus by which the difference in frictional coefficient in the longitudinal direction of working rolls due to grinding is reduced so that meandering of a rolling stock at the time of grinding during pass rolling is prevented, thereby preventing drawing (squeezing) of the rolling stock or bad product shape due to meandering, lowering of product quality and lowering of productivity. (1) In order to attain the above object, according to the invention, there is provided an online roll grinding method using at least one upper-side roll grindstone device and at least one lower-side roll grindstone device faced respectively to an upper-lower pair of working rolls to grind surfaces of the working rolls being rotated, and a moving device for moving the upper-side roll grindstone device and lower-side roll grindstone device along the axial direction of the working rolls, wherein grinding is carried out while moving the upper-side roll grindstone device and the lower-side roll grindstone device in reverse directions during rolling.

By this, grinding directions for the upper and lower working rolls are set in reverse relationship, namely, for example, the upper-side roll grindstone device is moved from the driving side toward the operating side while the lower-side roll grindstone device is moved from the operating side toward the driving side. Resultantly, the difference in frictional coefficient in the longitudinal direction of the upper and lower working rolls can be reduced even in online roll grinding carried out during pass rolling, whereby drawing (squeezing) of the rolling stock and bad product shape due to meandering can be obviated, and product quality and productivity can be enhanced. (2) In an online roll grinding method as set forth in (1) above, preferably, grinding by the upper-side roll grindstone device during rolling and grinding by the lower-side roll grindstone device during rolling are started simultaneously from opposite sides, and the moving velocity of the upper-side roll grindstone device and the moving velocity of the lower-side roll grindstone device are controlled to be equal to each other.

By this, the difference in frictional coefficient in the longitudinal direction of the upper and lower working rolls can be reduced stably. (3) Further, in order to attain the above object, according to the invention, there is provided an online roll grinding apparatus comprising at least one upper-side roll grindstone device and at least one lower-side roll grindstone device faced respectively to an upper-lower pair of working rolls to grind surfaces of the working rolls being rotated, and a moving device for moving the upper-side roll grindstone device and lower-side roll grindstone device along the axial direction of the working rolls, wherein a movement controlling device is provided for controlling the moving device so as to move the upper-side roll grindstone device and the lower-side roll grindstone device in reverse directions during rolling.

By this, the difference in frictional coefficient in the longitudinal direction of the upper and lower working rolls can be reduced even in online roll grinding carried out during pass rolling, whereby drawing (squeezing) of the rolling stock and bad product shape due to meandering can be obviated, and product quality and productivity can be enhanced. (4) In an online roll grinding apparatus as set forth in (3) above, the movement controlling device controls the moving device so that grinding by the upper-side roll grindstone device during rolling and grinding by the lower-side roll grindstone device during rolling are started simultaneously from opposite sides, and that the moving velocity of the upper-side roll grindstone device and the moving velocity of the lower-side roll grindstone device are equal to each other.

By this, the difference in frictional coefficient in the longitudinal direction of the upper and lower working rolls can be reduced stably.

The above and other objects, features and advantages of the present invention will become apparent from the following description and appended claims, taken in conjunction with the accompanying drawings which show by way of example some preferred embodiments of the invention.

DETAILED DESCRIPTION OF THE PREFERRED EMBODIMENTS

Figure 1:
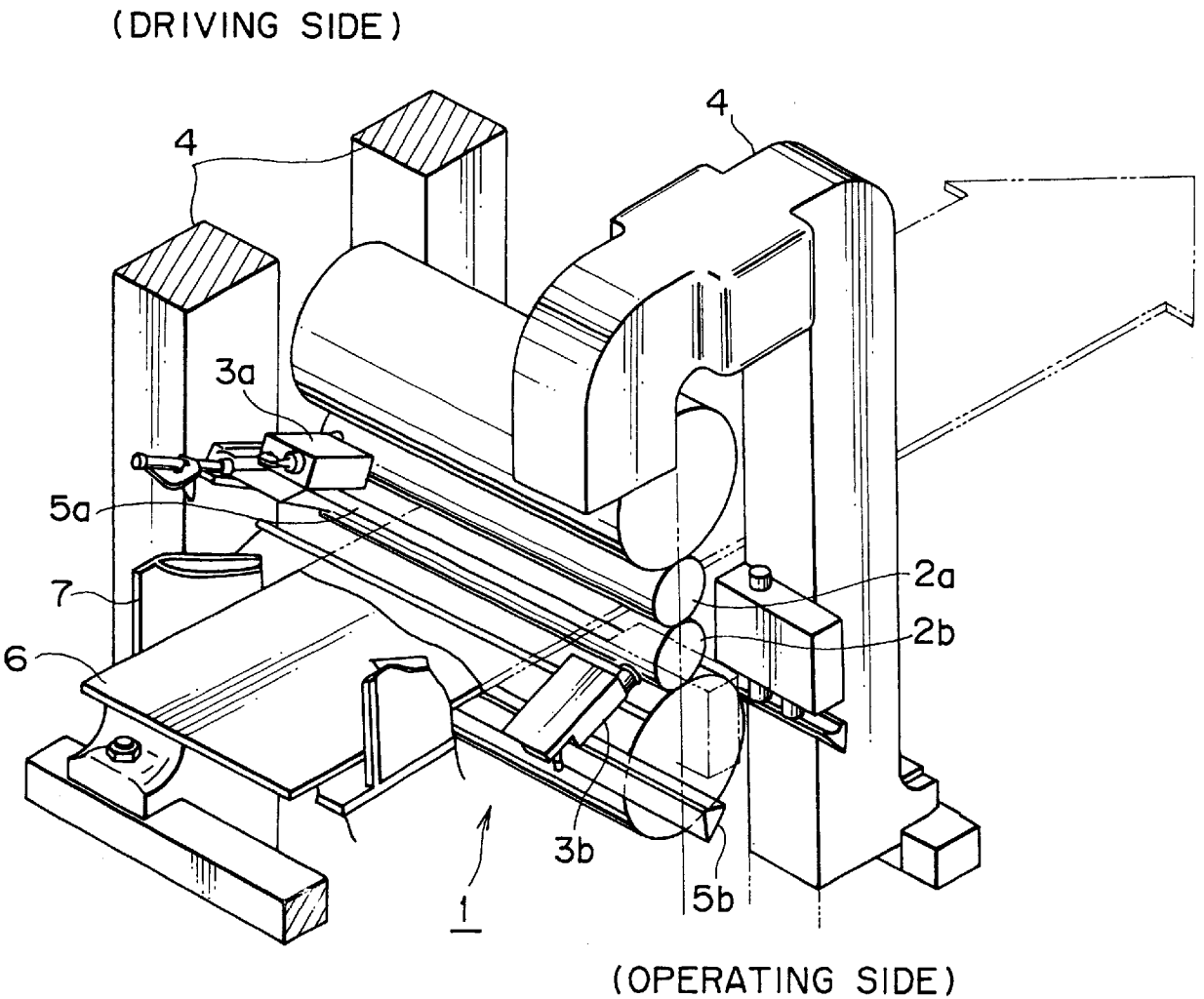
FIG. 1 is a perspective view of a rolling mill provided with an online roll grinding apparatus in the state at the time of start of grinding according to a first embodiment of the invention.

Now, some embodiments of the present invention will be described referring to the drawings.

Figure 2:
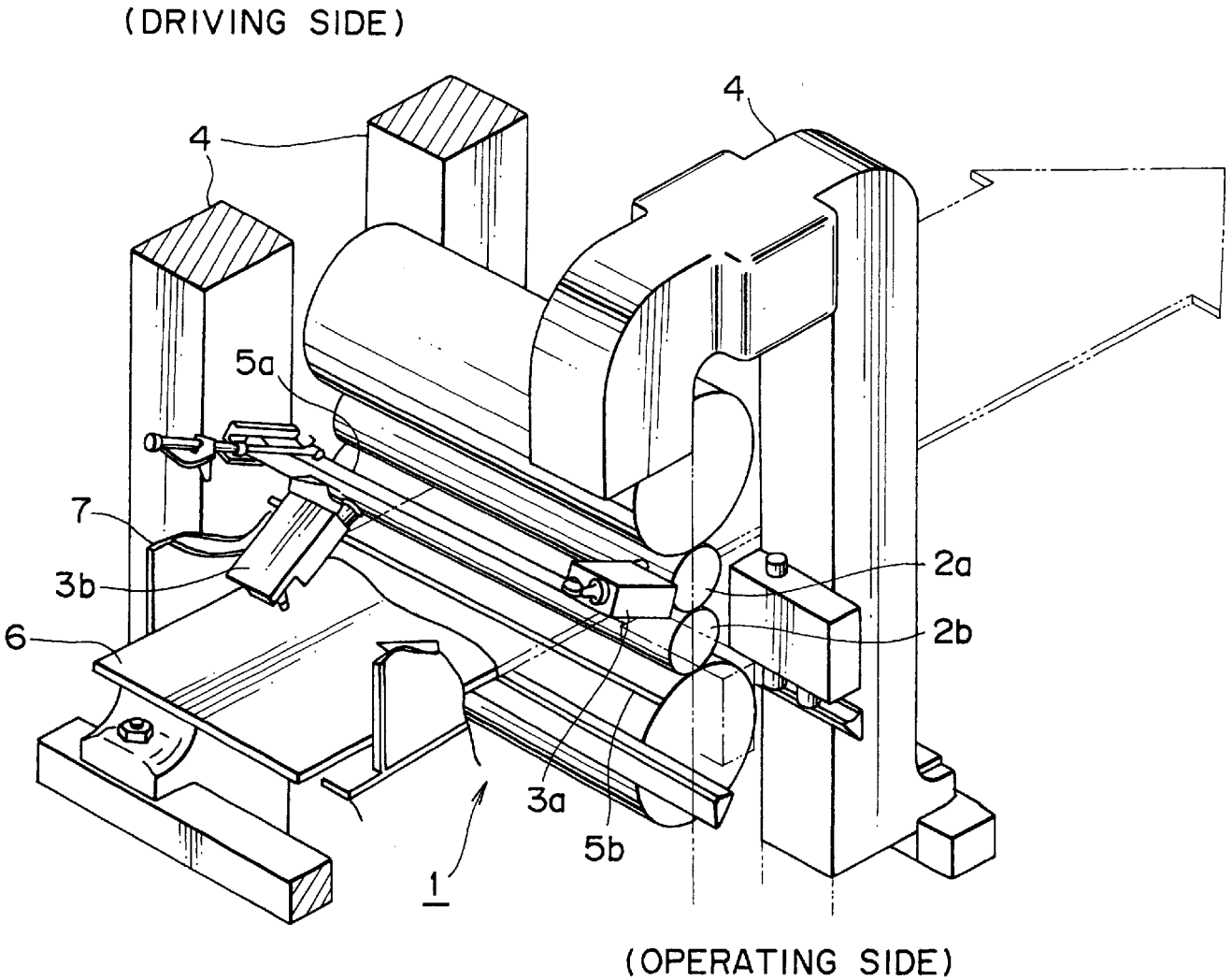
FIG. 2 is a perspective view of a rolling mill provided with an online roll grinding apparatus in the state at the time of end of grinding according to the first embodiment of the invention.

FIGS. 1 and 2 are perspective views of a rolling mill provided with an online roll grinding apparatus according to a first embodiment of the invention. In these figures, the online roll grinding apparatus according to the first embodiment comprises one grindstone device 3*a*, 3*b* each provided respectively for an upper-lower pair of working rolls 2*a*, 2*b*. Of the grindstone devices, the upper-side grindstone device 3*a* for grinding the upper working roll 2*a* is mounted traversely movably on an upper-side track rail 5*a* provided on a housing 4. On the other hand, the lower-side grindstone device 3*b* for grinding the lower working roll 2*b* is mounted traversely movably on a lower-side track rail 5*b* provided on a mill guide 7 for preventing a rolling stock 6 from meandering.

Figure 3A:
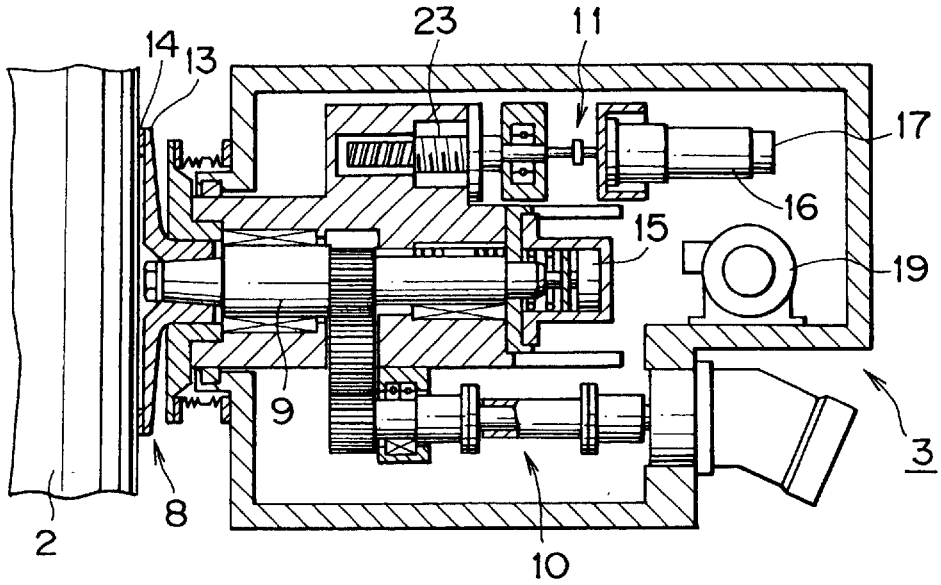
FIG. 3A is a horizontal sectional view as viewed from above of a grindstone device.
Figure 3B:
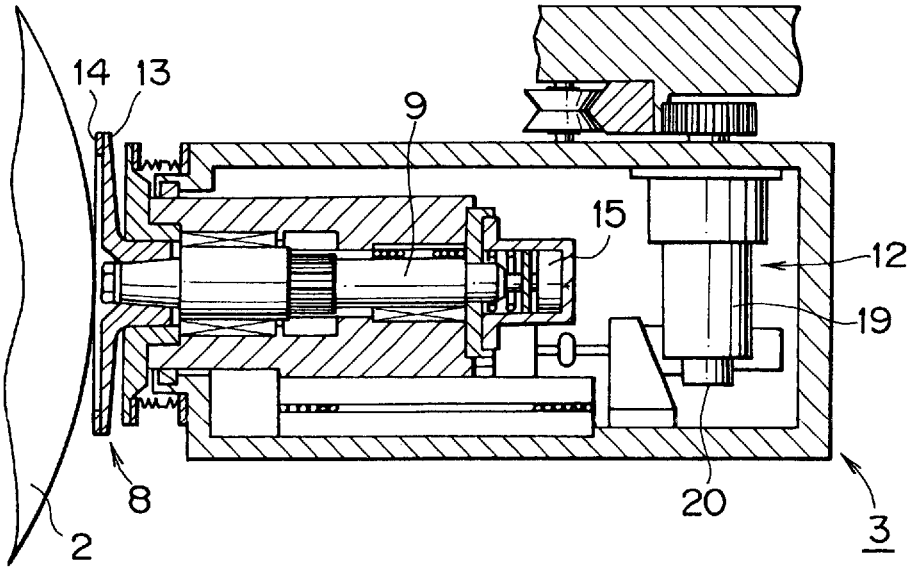
FIG. 3B is a vertical sectional view as viewed sideway of the grindstone device.

FIG. 3A is a horizontal sectional view of the grindstone device 3 as viewed from above, and FIG. 3B is a vertical sectional view of the grindstone device 3 as viewed sideways. In these figures, the grindstone device 3 comprises a planar-type rotary grindstone 8 for grinding the working roll 2, a grindstone rotation driver 10 for rotating the rotary grindstone 8 through a grindstone rotary shaft 9, a grindstone feeder 11 for pressing the rotary grindstone 8 against the working roll 2, and a grindstone traverse moving device 12 for moving the rotary grindstone 8 in the axial direction of the working roll 2.

The rotary grindstone 8 is composed by providing a grindstone 14 formed of super-abrasive grain on tip surfaces of a thin disk 13 formed of an elastic material and disposed coaxially with the grindstone rotary shaft 9. Deflection amount of the rotary grindstone 8 changes according to the contact force between the working roll 2 and the rotary grindstone 8, so that the rotary grindstone 8 functions to absorb vibrations of the working roll 2. The grindstone rotary shaft 9 is inclined at a minute angle relative to a plane surface orthogonal to the axis of the working roll 2 so that only a portion of the circumferential end of the rotary grindstone 8 makes contact with the surface of the working roll 2. A load cell 15 for measuring the contact force between the rotary grindstone 8 and the working roll 2 is provided at an end portion of the grindstone rotary shaft 9 opposite to the end at which the rotary grindstone 8 is provided.

Figure 4:
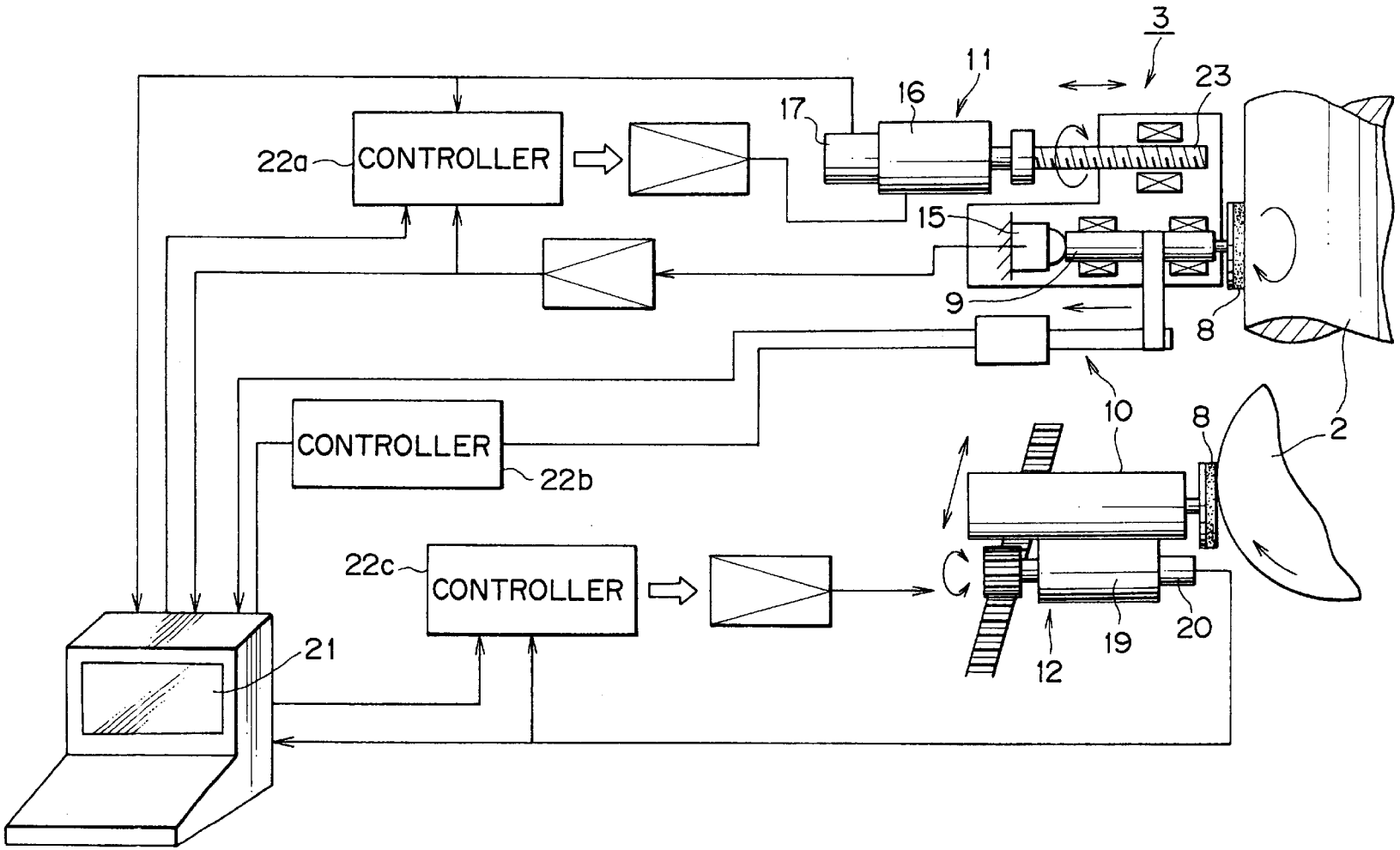
FIG. 4 is a system layout plan of the online roll grinding apparatus according to the first embodiment.

FIG. 4 is a system layout plan of the online roll grinding apparatus 1 according to this embodiment. In the figure, a feed motor 16 of the grindstone feeder 11 is provided with a feed quantity encoder 17 for measuring angle of rotation. Also, the grindstone traverse moving device 12 comprises a traverse motor 19, and is provided with a traverse quantity encoder 20 for measuring angle of rotation. Data signals from the load cell 15, the feed quantity encoder 17 and traverse quantity encoder 20 are inputted to a data processor 21, which outputs respective target control signals to controllers 22*a*, 22*b*, 22*c* for the motors.

A grinding method using the online roll grinding apparatus 1 of the embodiment constructed as above will be described below.

Figure 5:
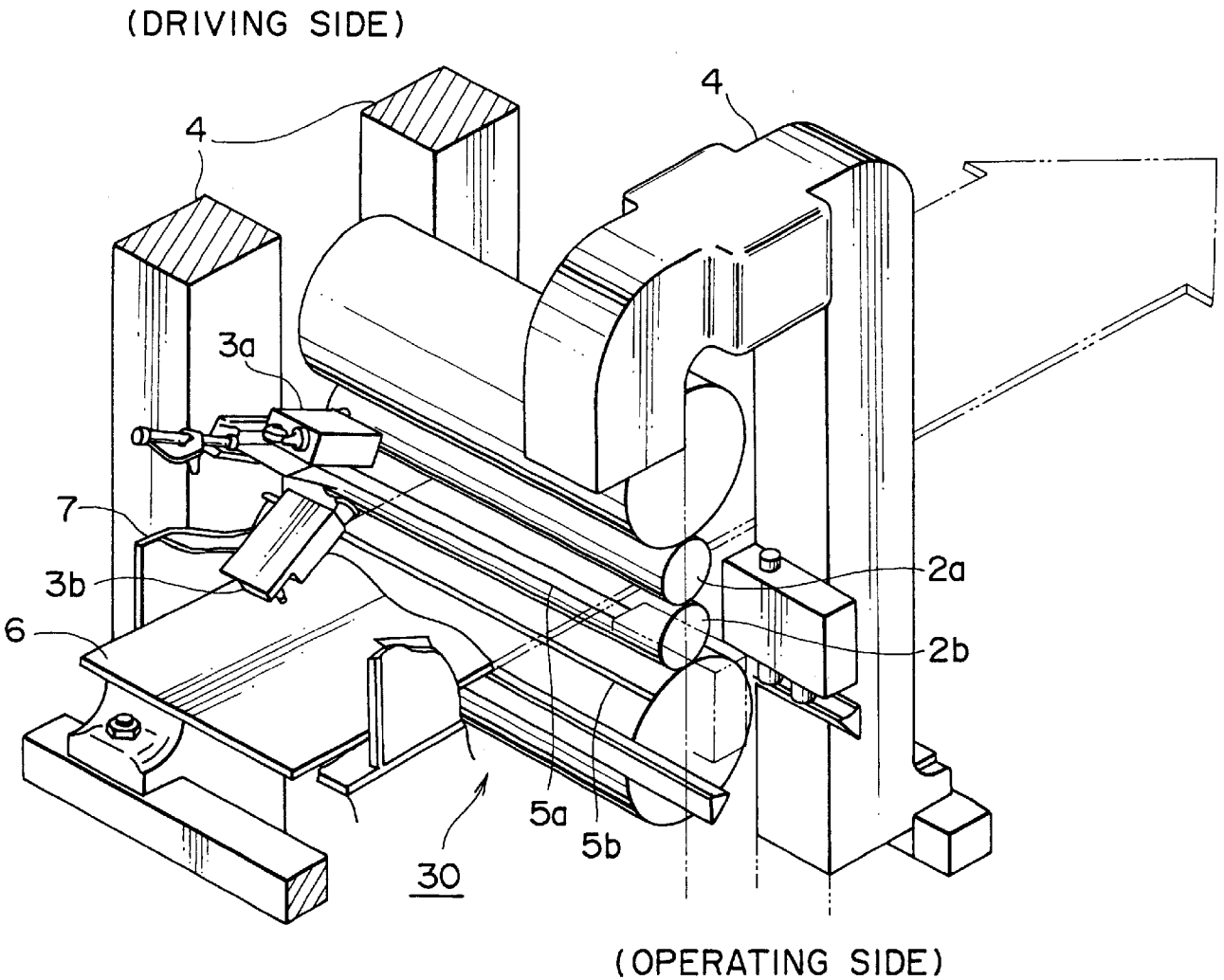
FIG. 5 PRIOR ART
FIG. 5 is a perspective view of a rolling mill provided with an online roll grinding apparatus in the state at the time of start of grinding according to the prior art.
Figure 6A:
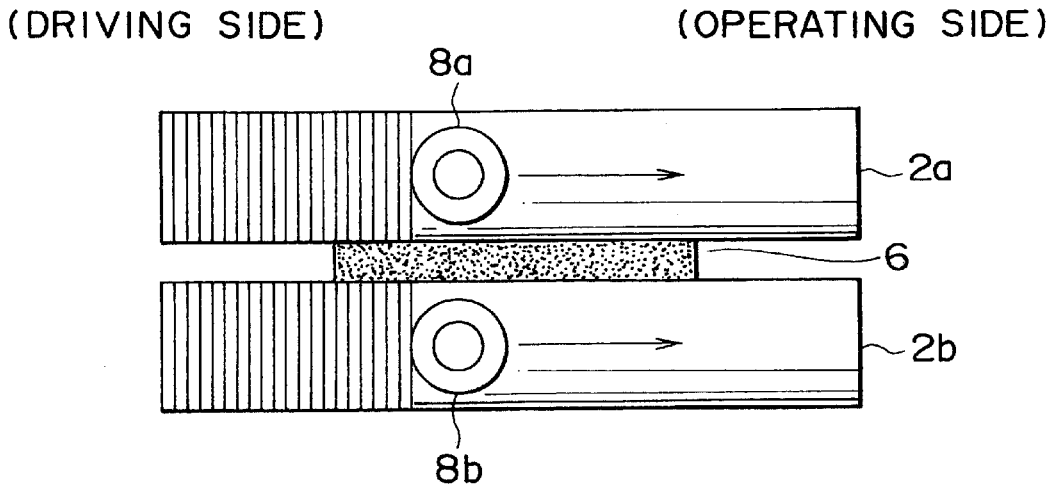
FIG. 6A PRIOR ART
FIGS. 6A to 6B are views illustrating the moving paths of upper and lower grindstone devices in an online roll grinding apparatus according to the prior art.
Figure 6B:
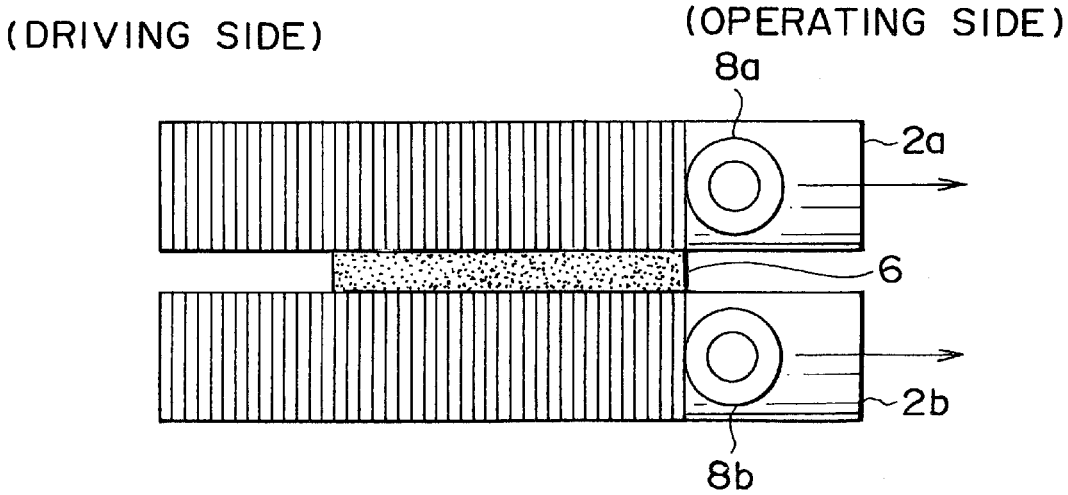
FIG. 6B PRIOR ART

For comparison, the case of an online roll grinding apparatus 30 according to the prior art will first be described. Generally, for ease of control, at the time of start of grinding, upper and lower grindstone devices 3*a*, 3*b* are both located on the same side, either driving side or operating side (in the figure, the driving side) as shown by way of example in FIG. 5. Then, simultaneously with the start of rolling of a rolling stock 6, upper and lower rotary grindstones 8*a*, 8*b* are brought into contact with the surfaces of working rolls 2*a*, 2*b* and are moved in the same direction, from the operating side toward the driving side or from the driving side toward the operating side, while performing rotational grinding. For example, where the same direction is from the driving side toward the operating side, the rotary grindstones 8*a*, 8*b* are moved along the path illustrated in FIG. 6A to FIG. 6B. In the figures, the ground surfaces are represented by the striped pattern. As shown in the figures, with the movement of the rotary grindstones 8*a*, 8*b*, the ground region is predominantly on the driving side for both the upper and lower working rolls 2*a*, 2*b*. The positional relationship results in that a difference in frictional coefficient is generated between the operating side and the driving side for the pair of working rolls as a whole, which causes drawing (squeezing) and bad shape of rolled product due to meandering of the rolling stock.

Figure 7A:
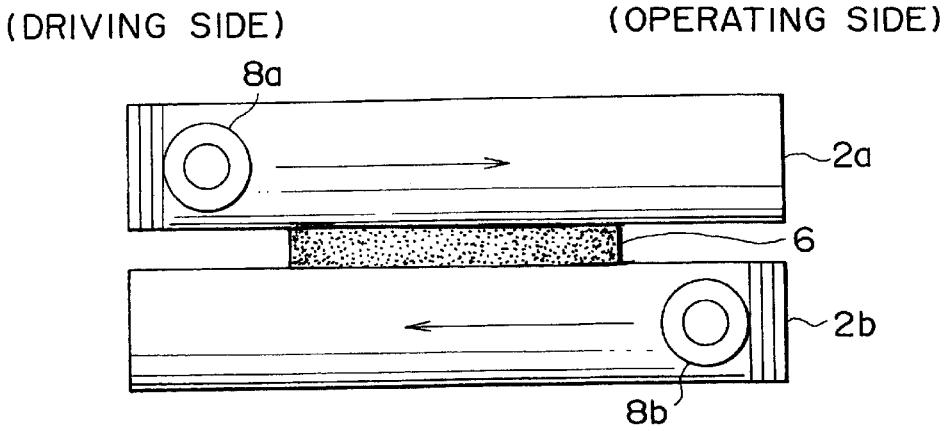
FIGS. 7A to 7C are views illustrating the moving paths of upper and lower grindstone devices in the online roll grinding apparatus according to the first embodiment of the invention.
Figure 7B:
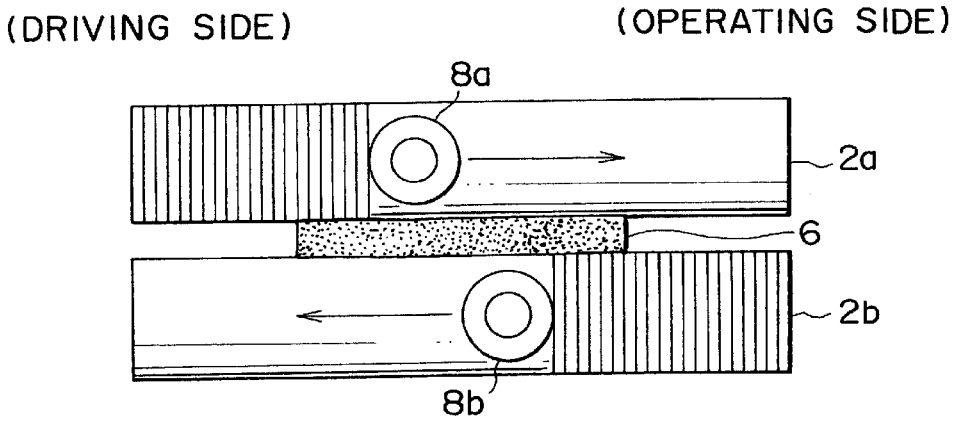
Figure 7C:
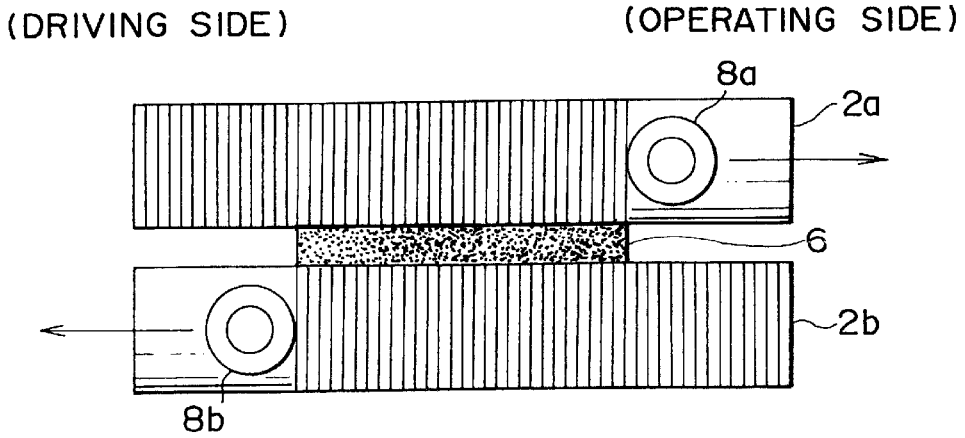

On the other hand, in the online roll grinding apparatus 1 according to the embodiment of the invention, the upper and lower grindstone devices 3*a*, 3*b* are located on the opposite sides at the time of starting grinding. For example, as shown in FIG. 1, the grindstone device 3*a* for the upper working roll 2*a* is situated on the driving side, while the grindstone device 3*b* for the lower working roll 2*b* is located on the operating side. When grinding is started, the grindstone devices 3*a*, 3*b* are moved in reverse directions, as shown in FIGS. 7A to 7C. Namely, the grindstone device 3*a* for the upper working roll 2*a* is moved from the driving side toward the operating side, whereas the grindstone device 3*b* for the lower working roll 2*b* is moved from the operating side toward the driving side. At the time of end of grinding, as shown in FIG. 2, the grindstone device 3*a* for the upper working roll 2*a* is located at the operating side, while the grindstone device 3*b* for the lower working roll 2*b* is located at the driving side. Thus, as the grindstone devices 3*a*, 3*b* on the upper and lower sides are moved in the reverse directions, the regions of grinding on the upper working roll 2*a* and the lower working roll 2*b* are respectively on the operating side and on the driving side; namely, the regions of grinding are located symmetrically to each other with respect to the center of the rolls. By this, frictional coefficients on the operating side and on the driving side can be equalized, and meandering of the rolling stock 6 and the resultant drawing (squeezing) or bad product shape due to meandering can be prevented.

Control of the online roll grinding apparatus 1 of the embodiment for carrying out the grinding method as above will now be described referring to FIG. 4. First, before starting grinding, the current standby positions of the upper and lower grindstone devices 3*a*, 3*b* are recognized and judged by the data processor 21.

When the standby positions of the grindstone devices 3*a*, 3*b* are judged to coincide with the predetermined opposite positions for the upper and lower working rolls 2*a*, 2*b*, the condition is made to be a standby condition waiting for an instruction to start grinding. If the grindstone devices 3*a*, 3*b* are judged as standing by at other positions than the opposite positions, the grindstone devices 3*a*, 3*b* are moved in the axial direction of the working rolls so that they stand by at the predetermined opposite positions. Next, other retrieval conditions are determined by the data processor 21, and instructions for starting grinding are simultaneously sent to the controllers 22*a*, 22*b*, 22*c* provided for the upper and lower grindstone devices 3*a*, 3*b*.

Then, the grindstone feed motor 16 and a grindstone feed screw 23 are driven to move the rotary grindstones 8 toward the roll surfaces of the working rolls 2 until load cells 15 recognizes the contact between the rotary grindstones 8 and the working rolls 2. After the contact is recognized, the traverse motors 19 are driven so that the upper and lower grindstone devices 3*a*, 3*b* start moving in opposite directions while grinding. Thereafter, the traversing and grinding are stopped at the instant when the traverse amounts of the grindstone devices 3*a*, 3*b* detected by the traverse quantity encoders 20 are judged to have reached a predetermined value.

Now, the relationship between the difference in frictional coefficient between the operating and driving sides and meandering of the rolling stock will be explained in detail. The load (Fall) exerted on the rolling stock 6 in a horizontal direction, i.e. pass direction, is related not only with the load (F) such as tension exerted on the rolling stock 6 during rolling but also with the frictional force (Ff) generated between the rolling stock 6 and the working roll 2 during rolling.

The load exerted in the pass direction (Fall) can be represented by the following expression:

$$Fall=F-Ff \quad \text{(Expression 1)}$$

The relationship of Expression 1 can also be applied to the loads in the pass direction on the operating side and the driving side. When the load on the operating side is represented as Fall(W) and the load on the driving side is represented as Fall(D), meandering of the rolling stock 6 during pass rolling indicates that the load difference ΔF in the pass direction between the operating side and the driving side is not 0 but has a certain non-zero value.

$$\Delta F=Fall(W)-Fall(D) \quad \text{(Expression 2)}$$

In Expression 1, the value which varies during rolling is only the frictional force (Ff) arising from frictional coefficient changed by grinding of the working roll surface by the online roll grinding apparatus, and, therefore, the load difference ΔF in the pass direction between the operating side and the driving side depends on the frictional coefficient.

Thus, the variation of frictional force due to variation of frictional coefficient results in that the load difference ΔF in the pass direction between the operating side and the driving side is not 0, and the phenomenon of meandering of the rolling stock 6 during pass rolling occurs.

In the next place, in connection with the relationship between frictional coefficient and meandering, the prior art and the present invention will be compared with each other.

In the case of an online roll grinding apparatus according to the prior art, the grindstone devices 3*a*, 3*b* for upper and lower working rolls start grinding from the same side and move in the same direction. Therefore, grinding regions are predominantly on one side, either the operating side or the driving side. Thus, for the pair of upper and lower working rolls as a whole, there arises a difference in frictional coefficient between the operating side and the driving side, which causes meandering of the rolling stock 6. Where grinding by the online roll grinding apparatus is not carried out, the surface roughness Ra of the working rolls is about 0.6 to 0.8 $\mu$m at the start of rolling, and is raised to an Ra value of about 1.5 to 3.0 $\mu$m as rolling is continued. Immediately after grinding by the online roll grinding apparatus is carried out, the surface roughness of the working rolls is improved to the Ra value at the start of rolling of about 0.6 to 0.8 $\mu$m. Due to the difference in surface roughness, the frictional coefficient between the rolling stock 6 and the working roll 2 is varied.

Adopting the known frictional coefficients mentioned above as frictional coefficients on the operating side and driving side, the meandering of the rolling stock 6 will be investigated. If the upper and lower grindstone devices 3*a*, 3*b* both start grinding from the operating side, the frictional coefficient $\mu$Ws on the operating side is as low as an Ra value of about 0.6 to 0.8 $\mu$m, while the frictional coefficient $\mu$Ds on the driving side is as high as an Ra value of about 1.5 to 3.0 $\mu$m. Thus, the frictional force which would push the rolling stock 6 toward the inlet side on the operating side with the lower frictional coefficient is smaller, and the frictional force on the driving side with the higher frictional coefficient is larger. Therefore, the pass direction load F(W) on the operating side and the pass direction load F(D) on the driving side are in the relationship of F(W)>F(D). Namely, elongation to the operating side occurs, and the rolling stock 6 bends from the operating side toward the driving side, resulting in meandering.

In contrast, the grindstone devices 3*a*, 3*b* according to the embodiment of the invention are moved in opposite directions between the upper and lower working rolls 2*a*, 2*b*. In this case, the force generated between the upper working roll 2*a* and the rolling stock 6 due to the difference in frictional force and tending to bend the rolling stock 6 is always balanced with the force generated between the lower working roll 2*b* and the rolling stock 6 and tending to bend the rolling stock 6. Therefore, the load difference $\Delta$F in the pass direction between the operating side and the driving side is zero. As a result, meandering of the rolling stock does not occur, so that drawing (squeezing) and bad product shape can be prevented from occurring.

For the above-mentioned balance to be established stably, the ground regions of the upper and lower working rolls 2*a*, 2*b* must be substantially equal in length. For satisfying this condition, it is required that the grindstone devices 3*a*, 3*b* be brought into contact respectively with the working rolls 2*a*, 2*b* to start grinding at roughly the same timing, and the grindstone devices 3*a*, 3*b* be moved in the axial direction of the working rolls at equal velocities. It has been known, however, that the concord of the start timings of grinding is not so strictly required, and some discrepancy would not have large influence from a mechanical point of view.

As has been described above, according to the embodiment of the invention, grinding directions for the upper and lower working rolls are set opposite to each other. By this arrangement, it is possible to reduce the difference in frictional coefficient in the longitudinal direction of the upper and lower working rolls, even in online roll grinding carried out during pass rolling, to prevent drawing (squeezing) or bad product shape from occurring due to meandering of the rolling stock, and to enhance product quality and productivity.

Figure 8:
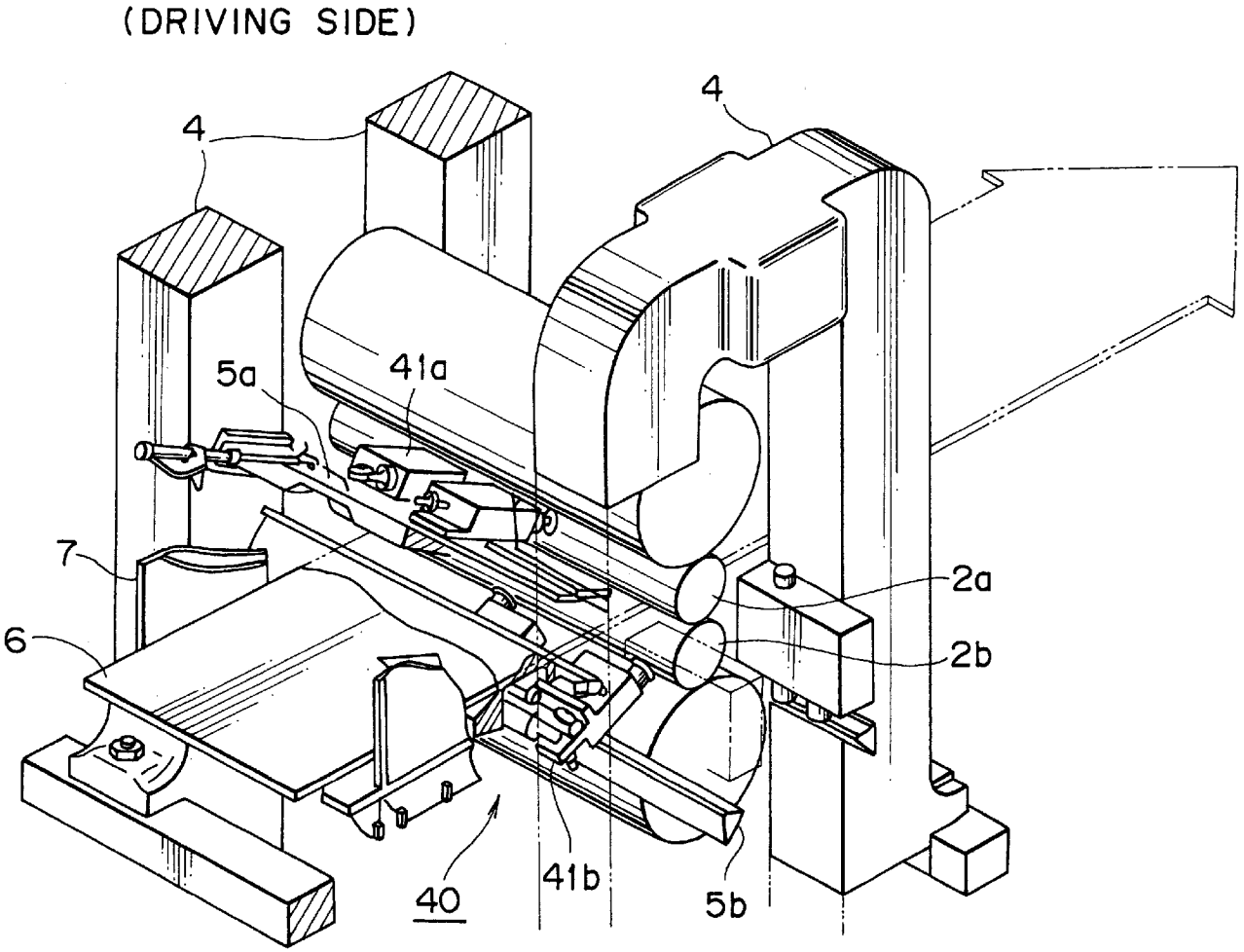
FIG. 8 is a perspective view of a rolling mill provided with an online roll grinding apparatus in the state at the time of start of grinding according to a second embodiment of the invention.

An online roll grinding apparatus 40 according to a second embodiment of the invention will be described referring to FIG. 8. FIG. 8 is a perspective view of a rolling mill provided with the online roll grinding apparatus 40 according to the second embodiment of the invention. In the figure, the online roll grinding apparatus of this embodiment comprise a total of four grindstone devices 3, two for the upper working roll 2*a* and two for the lower working roll 2*b*. An upper grindstone device set 41*a* comprising a set of two grindstone devices for grinding the upper working roll 2*a* is mounted traversely movably on an upper track rail 5*a* mounted on a housing 4. On the other hand, a lower grindstone device set 41*b* comprising a set of two grindstone devices for grinding the lower working roll 2*b* is mounted traversely movably on a lower track rail 5*b* mounted on a mill guide 7 for prevention of meandering of the rolling stock 6.

Figure 9:
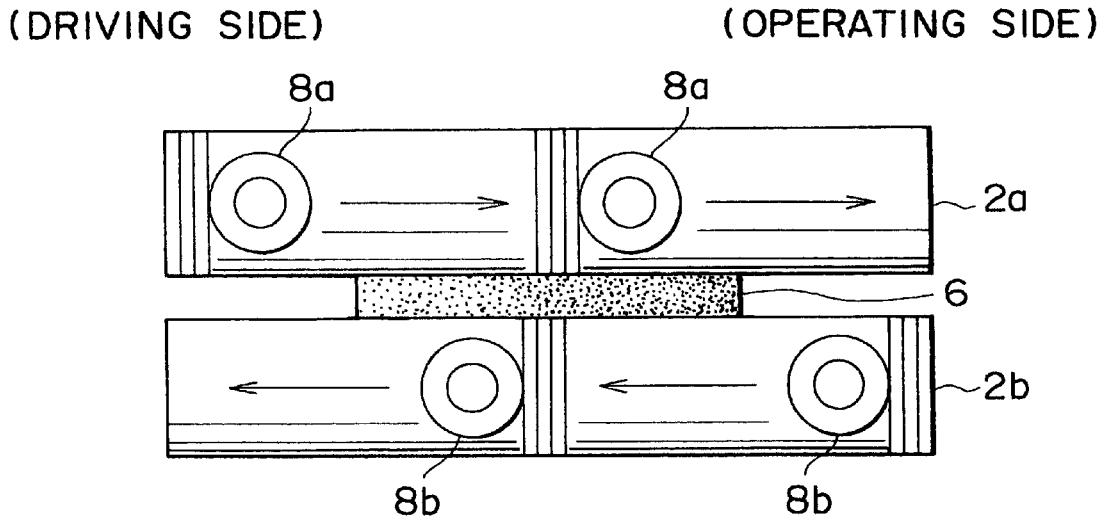
FIG. 9 is a plan illustrating the moving paths of upper and lower grindstone devices in the online roll grinding apparatus according to the second embodiment of the invention.

Two regions where the upper and lower working rolls 2*a*, 2*b* are ground by the upper grindstone device set 41*a* and the lower grindstone device set 41*b* are always set in symmetrical relationship with respect to the center of rolls, and are moved in opposite directions, during when grinding is conducted. For instance, where the upper grindstone device set 41*a* is moved from the driving side toward the operating side and the lower grindstone device set 41*b* is moved from the operating side toward the driving side, the movement paths are as shown in FIG. 9. The distance between two rotary grindstones 8 in each of the grindstone device sets 41*a*, 41*b* is roughly one half of the overall length of the working roll. By this arrangement, online roll grinding can be carried out in a shorter time.

Thus, according to the present embodiment, efficient online roll grinding can be carried out in a shorter time while maintaining the functions to prevent drawing (squeezing) or bad product shape due to meandering of the rolling stock from occurring in online roll grinding performed during pass rolling.

While preferred embodiments have been described, variations thereto will occur to those skilled in the art within the scope of the present inventive concepts which are delineated by the following claims.

What is claimed is:

1. An online roll grinding method using at least one upper-side roll grindstone device and at least one lower-side roll grindstone device faced respectively to an upper-lower pair of working rolls to grind surfaces of said working rolls being rotated, and a moving device for moving said upper-side roll grindstone device and lower side roll grindstone device along the axial direction of said working rolls, wherein grinding is carried out while moving said upper-side roll grindstone device and said lower-side roll grindstone device in reverse directions during rolling.

2. An online roll grinding method as set forth in claim 1, wherein grinding by said upper-side roll grindstone device during rolling and grinding by said lower-side roll grindstone device during rolling are started simultaneously from opposite sides, and the moving velocity of said upper-side roll grindstone device and the moving velocity of said lower-side roll grindstone device are controlled to be equal to each other.

3. An online roll grinding apparatus comprising at least one upper-side roll grindstone device and at least one lower-side roll grindstone device faced respectively to an upper-lower pair of working rolls to grind surfaces of said working rolls being rotated, and a moving device for moving said upper-side roll grindstone device and lower-side roll grindstone device along the axial direction of said working rolls, wherein a movement controlling device is provided for controlling said moving device so as to move said upper-side roll grindstone device and said lower-side roll grindstone device in reverse directions during rolling.

4. An online roll grinding apparatus as set forth in claim 3, wherein said movement controlling device controls said moving device so that grinding by said upper-side roll grindstone device during rolling and grinding by said lower-side roll grindstone device during rolling are started simultaneously from opposite sides, and that the moving velocity of said upper-side roll grindstone device and the moving velocity of said lower-side roll grindstone device are equal to each other.

* * * * *